United States Patent [19]

Kamide et al.

[11] Patent Number: 4,904,161

[45] Date of Patent: Feb. 27, 1990

[54] APPARATUS FOR CONTROLLING HYDRUALIC PUMP

[75] Inventors: Takao Kamide, Oiso; Kentaro Nakamura, Hiratsuka; Takaichi Saigo, Chigasaki; Katsumi Yoshida, Hiratsuka, all of Japan

[73] Assignee: Kabushiki Kaisha Komatsu Seisakusho, Japan

[21] Appl. No.: 183,742

[22] PCT Filed: Aug. 15, 1987

[86] PCT No.: PCT/JP87/00610

§ 371 Date: Mar. 25, 1988

§ 102(e) Date: Mar. 25, 1988

[87] PCT Pub. No.: WO88/01349

PCT Pub. Date: Feb. 25, 1988

[30] Foreign Application Priority Data

| | | | |
|---|---|---|---|
| Aug. 15, 1986 | [JP] | Japan | 61-191248 |
| Oct. 17, 1986 | [JP] | Japan | 61-247085 |
| Dec. 3, 1986 | [JP] | Japan | 288366 |
| Dec. 18, 1986 | [JP] | Japan | 61-302343 |

[51] Int. Cl.[4] ..... F04B 49/08

[52] U.S. Cl. ..... 417/22; 417/34; 417/218

[58] Field of Search ..... 417/18, 22, 34, 218, 417/222; 60/433, 434

[56] References Cited

U.S. PATENT DOCUMENTS

| | | | |
|---|---|---|---|
| 4,395,199 | 7/1983 | Izumi et al. | 417/34 X |
| 4,423,707 | 8/1985 | Mitchell | 417/34 |
| 4,510,750 | 4/1985 | Izumi et al. | 17/218 X |
| 4,600,364 | 7/1986 | Nakatani et al. | 417/218 X |
| 4,637,781 | 1/1987 | Akiyama et al. | 417/218 X |

FOREIGN PATENT DOCUMENTS

| | | |
|---|---|---|
| 57-179387 | 11/1982 | Japan . |
| 60-204987 | 10/1985 | Japan . |
| 62-41850 | 3/1987 | Japan . |
| 62-87631 | 4/1987 | Japan . |
| 62-28318 | 6/1987 | Japan . |

*Primary Examiner*—Leonard E. Smith

*Attorney, Agent, or Firm*—Welsh & Katz, Ltd.

[57] ABSTRACT

An apparatus for controlling a variable displacement type hydraulic pump including an engine as a driving power source is disclosed. The subject invention detects the number of revolutions of the engine and the pressure of hydraulic oil delivered from the hydraulic pump, and sets a pump absorption torque characteristic which decreases in relation to the number of revolutions of the engine. The inclination angle of a swash plate in the pump is detected with reference to the pump absorption torque characteristic and the pressure of hydraulic oil delivered from the pump, and the swash plate in the pump can be controlled so as to assure its inclination angle; the number of revolutions of the engine can be reduced without the absorption torque of the hydraulic pump exceeding the allowable torque of the engine. When the controlled apparatus is utilized, the number of revolutions of the engine can be optimally reduced and fuel consumption cost reduced correspondingly. The inclination angle of the swash plate in the pump can be increased to a maximum so that the operational efficiency of the pump is increased.

16 Claims, 10 Drawing Sheets

APPARATUS FOR CONTROLLING HYDRUALIC PUMP

TECHNICAL FIELD

The present invention relates to an apparatus for controlling a variable displacement type hydraulic pump adapted to be driven by an engine.

BACKGROUND ART

A construction machine such as power shovel or the like is equipped with a variable displacement type hydraulic pump adapted to be driven by an engine.

A hitherto knownapparatus for controlling a variable displacement type hydraulic pump has a function of properly controlling an inclination angle of a swash plate in the pump to assure that an output torque from the engine matches with an absorption torque absorbed by the pump at all times in order to effectively utilize the output torque from the engine.

However, the conventional apparatus has a drawback that an improvement effect covering a fuel consumption characteristic of the engine and a pump efficiency can not be expected due to the fact that the apparatus is intended to control only the variable displacement type hydraulic pump.

On the other hand, an apparatus for varying an absorption torque absorbed by a variable displacement type hydraulic pump in dependence on a given operation mode (operation to be performed under a high intensity of load, operation to be performed under a low intensity of load or the like) was already proposed by a Japanese Laid-Open Patent No. 204987/1985.

However, the last-mentioned conventional apparatus has a drawback that it can deal with only a problem in respect of such a state that the engine is excessively heated. Incidentally, it is thinkable as a countermeasure to be taken at the time when the engine is excessively heated that an output horsepower from the engine and the number of revolutions of the engine are reduced. However, when this countermeasure with which an absorption horsepower absorbed by the pump which is a direct load exerted on the engine does not vary is employed, it not only takes a long time until a normal operational state is restored from the state that the engine is excessively heated, resulting in a satisfactory operation failing to be performed, but also a running time of the engine is shortened.

Further, the conventional apparatuses detect a pressure of hydraulic oil delivered from the pump with the use of pressure detecting means in order to control an inclination angle of a swash plate in the pump, but there arises such a problem that operation of the engine is interrupted or an output torque from the engine fails to be transmitted to the pump when an abnormality relative to the pressure detecting means occurs, because they can not entirely deal with the above-mentioned abnormality.

An object of the present invention is to provide an apparatus for controlling a hydraulic pump which assures that a fuel consumption cost required for an engine can be reduced and moreover an operational efficiency of the hydraulic oil can be improved substantially.

Other object of the present invention is to provide an apparatus for controlling a hydraulic oil which assures that a normal operational state of the engine can be restored when the engine is excessively heated.

Another object of the present invention is to provide an apparatus for controlling a hydraulic pump which assures that the pump can be operated even at the time when means for detecting a pressure of hydraulic oil delivered from the pump becomes abnormal in function.

DISCLOSURE OF THE INVENTION

According to one aspect of the present invention, an apparatus for controlling a variable displacement type hydraulic pump comprises means for detecting the number of revolutions of and engine, means for detecting a pressure of hydraulic oil delivered from the pump, means for setting a pump absorption torque characteristic which monotonously decreases with reference to the number of revolutions of the engine, means for looking for an inclination angle of a swash plate in the pump with reference to the pump absorption torque characteristic and the pressure of hydraulic oil delivered to the pump, means for controlling the swash plate in the pump so as to assure the aforesaid inclination angle of the swash plate, and means for reducing the number of revolution of the engine under a condition that an absorption torque absorbed by the pump does not exceed an allowable torque of the engine.

Further, according to other aspect of the present invention, an apparatus for controlling a variable displacement type hydraulic pump comprises means for detecting the number of revolutions of an engine, means for setting a target pump absorption torque $T_P$ in accordance with the following equation, $$T_P = T_E(N_c) + (N - N_c)$$

where $T_E(N_c)$ ; rated torque characteristic of the engine at a predetermined revolution number range K ; constant N ; number of revolutions of the engine $N_c$; target number of revolutions of the engine and means for controlling a swash plate in the pump so as to obtain an absorption torque with reference to the target pump absorption torque and a pressure of hydraulic oil delivered from the pump.

Further, according to another aspect of the present invention, an apparatus for controlling a variable displacement type hydraulic pump comprises means for detecting the number of revolutions of an engine, means for detecting a pressure of hydraulic oil delivered from the pump, means for detecting that the engine is excessively heated, means for indicating an operation mode corresponding to an intensity of load, means for setting a pump absorption horsepower characteristic corresponding to the operation mode and setting a pump absorption horsepower characteristic for a light intensity of load in place of the existent pump absorption horsepower characteristic which is set for a case where it is detected that the engine is excessively heated, means for looking for an inclination angle command relative to a swash plate in the pump so as to obtain an absorption horsepower which conforms to the set absorption horsepower characteristic with reference to the set absorption horsepower characteristic, the number of revolutions of the engine and the pressure of hydraulic oil delivered from the pump, means for reducing the number of revolutions of the engine when it is detected that the engine is excessively heated, and means for controlling the swash plate so as to allow an inclination angle of the swash plate in the pump to assume a magnitude which conforms to the swash plate inclination angle command.

Furthermore, according to further another aspect of the present invention, an apparatus for controlling a variable displacement type hydraulic pump comprises means for setting a pump absorption torque characteristic so as to reduce an absorption torque absorbed by the pump lower than an output torque from the engine and means for controlling an inclination angle of a swash plate in the pump so as to allow the absorption torque absorbed by the pump to exhibit a value which conforms to the pump absorption torque characteristic when means for detecting a pressure of hydraulic oil delivered from the pump becomes abnormal in function.

BEST MODE FOR CARRYING OUT THE INVENTION

Now, the present invention will be described in a greater detail hereunder with reference to the accompanying drawings which illustrate preferred embodiments thereof.

Figure 6:
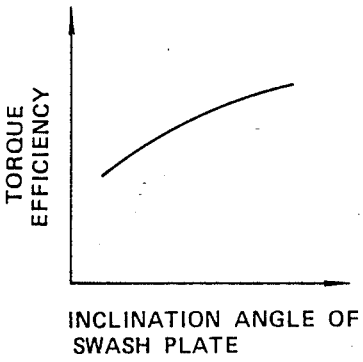
FIG. 6 is a graph exemplifying a relationship between an inclination angle of a swash plate and a torque efficiency.
Figure 7:
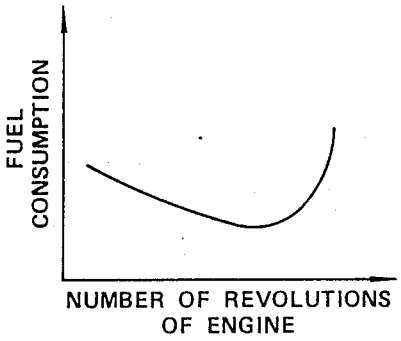
FIG. 7 is a graph exemplifying a relationship between the number of revolutions of an engine and a fuel consumption cost.

As is apparent from FIG. 6, a hydraulic pump has an advantage in terms of torque efficiency when it is operated with a high magnitude of inclination angle of a swash plate. Further, the hydraulic pump has an advantage in terms of reduction of fuel consumption cost when an engine is operated with a number of revolutions thereof which is reduced to a certain level, as shown in FIG. 7.

Figure 1:
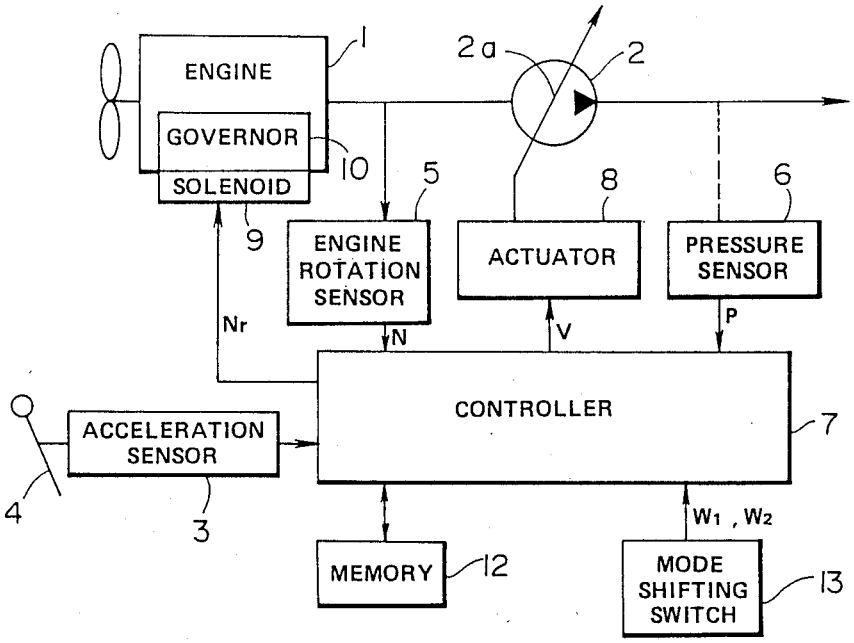
FIG. 1 is a block diagram illustrating an apparatus for controlling a hydraulic pump in accordance with an embodiment of the present invention.

Referring to FIG. 1 which schematically illustrates an apparatus for controlling a variable displacement type hydraulic pump in accordance with an embodiment of the invention, the following relationship is established when an absorption horsepower absorbed by the variable displacement type hydraulic pump 2 driven by an engine 1 is represented by $W_p$.

$$\begin{aligned} W_p &= K_1 \cdot P \cdot Q \\ &= K_2 \cdot P \cdot N \cdot V \end{aligned} \tag{1}$$

where $P$: pressure of hydraulic oil delivered from the pump (Kg/cm$^2$)

$Q$: flow rate of hydraulic oil delivered from the pump (liter/min)

$N$: number of revolutions of the engine (rpm)

$V$: flow rate of hydraulic oil delivered from the pump per one revolution of the pump (cc/rev)

$K_1$, $K_2$: constant

As will be readily understood from the above Equation (1), Q ( N·V ) is determined by N and V, and each of these parameters can take various value. Namely, to obtain a same value of Q, it suffices that a value of N is decreased and a value of V is increased correspondingly. For instance, by properly controlling a value of Q in relation to a voluntary value of P, the absorption horsepower $W_P$ absorbed by the pump 2 can be so controlled that it is kept constant.

A pump absorption torque $T_{P\text{-}W}$ required for controlling in order that the absorption horsepower $W_P$ absorbed by the pump 2 is kept constant is represented by the following equation.

$$T_{P-W} = K_3 \cdot \frac{W}{N} = f(N) \tag{2}$$

where

W ; constant work to be conducted by the pump $K_3$; constant

Further, to obtain the absorption torque $T_{P\text{-}W}$, a flow rate V of hydraulic oil delivered from the pump 2 per one revolution of the pump 2 is represented by the following equation.

$$V = \frac{T_{P-W}}{K_4 \cdot P} = \frac{f(N)}{K_4 \cdot P} \tag{3}$$

where $K_4$; constant

Figure 3:
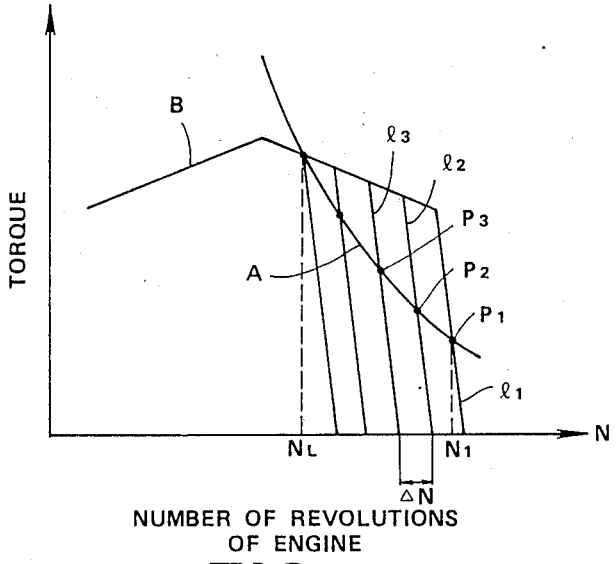
FIG. 3 is a graph illustrating a function of the apparatus shown in FIG. 1.

Accordingly, a torque efficiency of the pump can be increased and a fuel consumption cost of the engine 1 can be reduced under such a condition that the absorption horsepower $W_P$ absorbed by the pump is maintained at a constant value of W, if the engine is controlled so as to reduce N on the assumption that the absorption torque $T_{P\text{-}W}$ absorbed by the pump is represented as a monotonously decreasing function A (hyperbolic function) using the number N of revolutions of the engine as a variable as shown in FIG. 3 and V is represented as a function which is obtained by dividing f (N) by P.

It should be noted that since V has the maximum value $V_{max}$ which is set under a rated condition of the pump 2, N can not be reduced thoughtlessly. Further, as is apparent from the Equation (2), since the absorption torque $T_{P\text{-}W}$ increases as N is reduced, there is a danger that the absorption torque $T_{P\text{-}W}$ exceeds a rated torque B shown in FIG. 3 in dependence on an extent of reduction of N. Accordingly, in view of the above-mentioned fact, N can be reduced thoughtlessly. Namely, as shown in FIG. 3, the number of revolutions of the engine can not be reduced lower than $N_L$, because the absorption torque $T_{P\text{-}W}$ absorbed by the pump is in excess of the rated torque of the engine in a case where the number of revolutions of the engine is reduced lower than $N_L$.

In an embodiment of the present invention to be described below, improvement of an operational efficiency of the pump as well as improvement of fuel consumption cost are achieved while the above-mentioned facts are taken into account.

Incidentally, the aforesaid rated torque B is set by means of a governor 10. Pressurized hydraulic oil delivered from the pump 2 is fed to a hydraulic actuator (hydraulic motor, hydraulic cylinder or the like) usable for a construction machine which is not shown in the drawings.

Referring to FIG. 1 again, a signal corresponding to an extent of actuation of an acceleration lever 4 is outputted from an acceleration sensor 3, a signal representative of the actual number N of revolutions of the engine 1 is outputted from an engine rotation sensor 5, and a signal representative of a pressure P of hydraulic oil delivered from the pump 2 is outputted from a pressure sensor 6. Each of the output signals outputted from these sensors is inputted into a controller 7.

The signal outputted from the acceleration sensor 3 is subjected to amplifying or the like processing in the controller 7 and thereafter it is inputted as a signal representative of the target number $N_r$ of revolutions of the engine into a proportion solenoid 9 which will be described later.

The actuator 8 for driving a swash plate is composed of, for instance, a servo valve, a hydraulic cylinder and others each of which is not shown in the drawings, and a swash plate 2a in the pump 2 is driven by the actuator 8.

A pump absorption torque characteristic A and the number $N_L$ of revolutions of the engine both of which are shown in FIG. 3 are previously stored in a memory 12.

Figure 4:
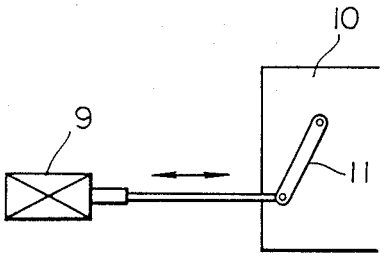
FIG. 4 is a schematic view of a proportion solenoid for actuating a fuel control lever.

As shown in FIG. 4, the proportion solenoid 9 is provided as an actuator for actuating a fuel control lever 11 on the governor 10 and an amount of fuel injection varies in dependence on an extent of displacement of the control lever 11 achieved under the effect of actuating force of the proportion solenoid 9.

Each of a plurality of regulation lines $l_1$, $l_2$ and others as shown in FIG. 3 is set in dependence on a magnitude of the target number $N_r$ of revolutions of the engine and, for instance, the regulation line set in a case where the acceleration lever 4 is turned to a full throttle position is identified by $l_1$.

Now, when it is assumed that the acceleration lever 4 is turned to the full throttle position and the variable displacement type hydraulic pump 2 is conducting a work W, a torque developed at an intersection $P_1$ where the regulation line $l_1$ intersects the pump absorption torque characteristic A represents a matching torque for both the engine 1 and the pump 2, and the number of revolutions of the engine measured at this moment is identified by $N_1$.

Figure 2:
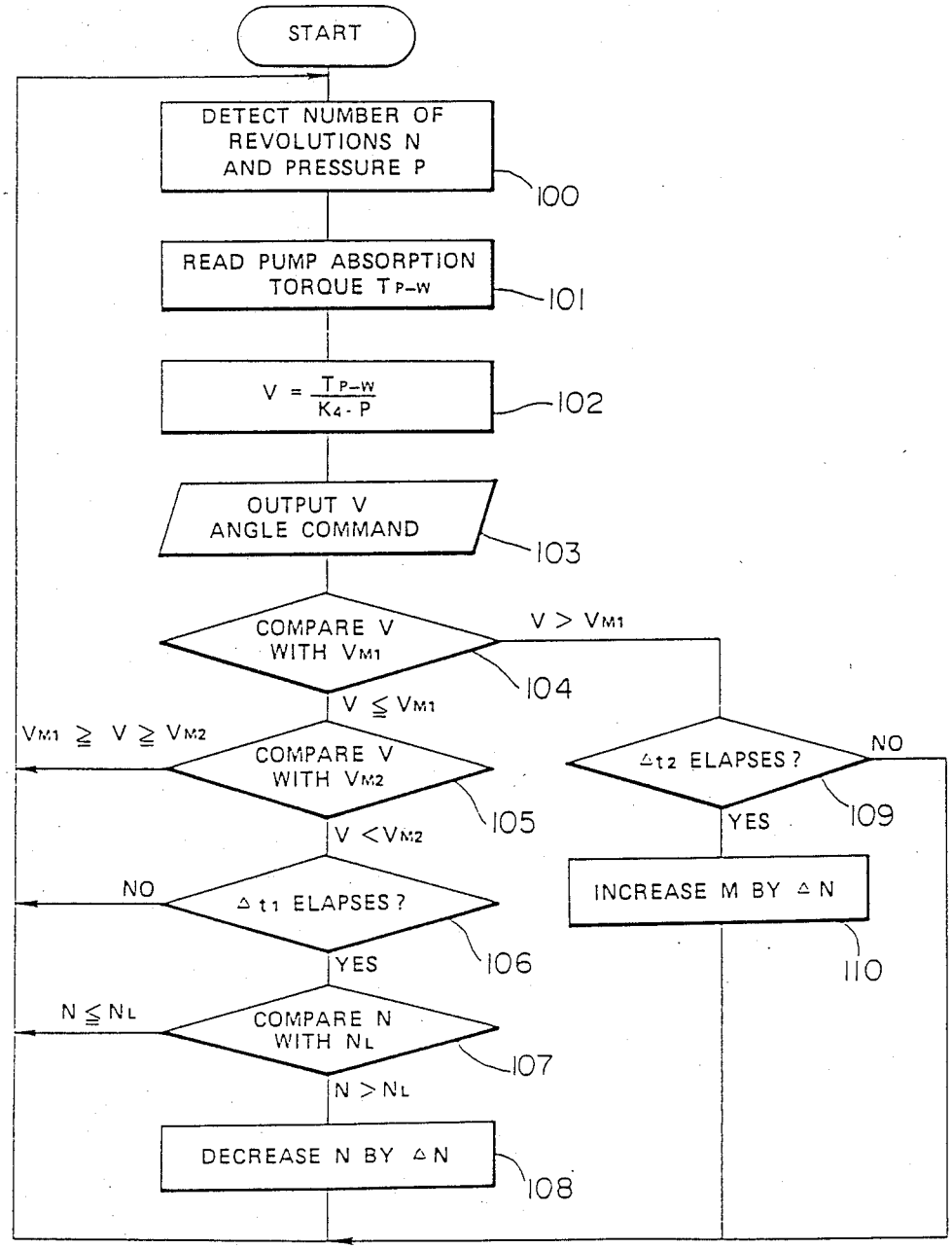
FIG. 2 is a flow chart illustrating procedures for a controller.

According to the embodiment of the present invention, the number of revolutions of the engine is caused to decrease from the state that the acceleration lever 4 is turned to the full throttle position. Now, the embodiment of the present invention will be described below in more details with reference to FIG. 2 which shows a plurality of processing procedures in the controller 7.

In the controller 7, the number N of revolutions of the engine and a pressure P of hydraulic oil delivered from the pump 2 are first detected in response to an output from the engine rotation sensor 5 and the pressure sensor 6 (Step 100) and the pump absorption torque $T_{P\text{-}W}$ represented by the Equation (2) and corresponding to the detected number N of revolutions of the engine is then read out of the memory 12 with reference to the detected number N of revolutions of the engine (Step 101).

Next, an arithmetic operation represented by the Equation (3) is executed with reference to the read absorption torque $T_{P\text{-}W}$ and the pressure P of hydraulic oil from the pump detected during the Step 100 (Step 102) and thereby a flow rate V of hydraulic oil delivered from the pump 2 per one revolution thereof is obtained. Incidentally, due to the fact that V and an inclination angle of the swash plate have a corresponding relationship therebetween as represented by a ratio of 1:1, the result is that the arithmetic operation executed during the Step 102 is intended to obtain an inclination angle of the swash plate.

Next, a command relative to the inclination angle for obtaining a flow rate V of hydraulic oil from the pump detected during the Step 102 is prepared and it is then applied to the actuator 8 for driving the swash plate (Step 103) whereby the absorption torque $T_{P\text{-}W}$ of the pump 2 represents a value at the point $P_1$ in FIG. 3.

During next Steps 104 and 105, a processing for comparing V obtained during the Step 102 with threshold values $V_{M1}$ and $V_{M2}$ is executed. The threshold values $V_{M1}$ and $V_{M2}$ are set to, for instance, 90 % and 80 % of the maximum value $V_{max}$ of V which is determined under a rated condition of the pump 2, and it is judged by them whether or not the swash plate in the pump 2 is driven to an angular position located in the proximity of the maximum inclination angle.

Now, when it is assumed that results of the comparison made during the Steps 104 and 105 are represented by an inequality of $V < V_{M2}$, that is to say, the swash plate in the pump 2 is not driven to an angular position in the proximity of the maximum inclination angle, a time-up equal to time $\Delta t_1$ (for instance, 100 ms) is judged by means of a first timer incorporated in the controller 7 (Step 106) and thereafter a comparison is made between the preset limitative number $N_L$ of revolutions of the engine (see FIG. 3) stored in the memory 12 and the existent number N ($=N_1$) of revolutions of the engine (Step 107).

Since an inequality of $N>N_L$ is established at this moment, a processing for reducing the number of revolutions of the engine from the existent number of revolutions of the engine by an extent of $\Delta N$ for instance, 15 rpm) is executed in the controller 7 (Step 108). That is to say, a proceeding for changing to $N_r-\Delta N$ the target number $N_r$ of revolutions of the engine commanded by actuation of the lever 4 is executed whereby the proportion solenoid 9 is actuated so as to reduce the number of revolutions of the engine 1 by an amount of $\Delta N$.

Thereafter, as long as results of the comparison made during the Step 105 is represented by an inequality of $V<V_{M2}$ and results of the comparison made during the Step 107 are represented by an inequality of $N>N_L$, procedures shown in the Steps 100 to 108 are executed repeatedly. That is to say, the target number of revolutions of the engine is changed in accordance with the following manner $N_r \rightarrow (N_r-\Delta N) \rightarrow (N_r-\Delta 2N) \rightarrow (N_r-\Delta 3\ N)$ whereby the number of revolutions of the engine is reduced by a step of $\Delta N$. As the number of revolutions of the engine is reduced in the above-described manner, the absorption torque $T_{P\text{-}W}$ read out of the memory 12 becomes larger, as shown by the characteristic A in FIG. 3, and thereby a value of command relative to an inclination angle to be outputted during the Step 103 becomes larger correspondingly. That is to say, an inclination angle of the swash plate in the pump 2 is increased.

Changing of the aforesaid target number of revolutions of the engine means that the regulation lines as shown in FIG. 3 are set in accordance with the following manner $l_1$—$l_2$—$l_3$—. Thus, the matching point relative to torque is changed in accordance with the following manner $P_1 \rightarrow P_2 \rightarrow P_3 \rightarrow$ While the number of revolutions of the engine is reduced in the above-described manner, a proceeding for reducing the number N of revolutions of the engine is interrupted when it is judged during the Steps 104 and 105 that an inequality of $V_{M1} \geqq V \geqq V_{M2}$ is established, and thereby procedures are caused to return to the Step 100.

Further, in a case where P is changed to decrease in accordance with variation of load (to reduce a load to be exerted on the pump) and it is then judged during the Step 104 that an inequality of $V>V_{M1}$ is established, a processing for increasing the existent number of revolutions of the engine by an amount of $\Delta N$ is executed (Step 110) after a time-up equal to $\Delta t_2$ is judged by a second timer (Step 109).

Since the processing executed during the Step 110 reduces $T_{P\text{-}W}$ shown in the Step 101, the result is that an inclination angle of the swash plate in the pump becomes smaller.

Next, description is made below as to a case where it is continuously judged during the Step 105 that an inequality of $V<V_{M2}$ is established and it is judged during the Step 107 that an equality of $N=N_L$ is established. In this case, since the absorption torque $T_{P\text{-}W}$ absorbed by the pump 2 is in excess of a torque allowable for the engine 1 as the number N of revolutions of the engine is reduced lower than the above-mentioned level, a processing to be executed during the Step 108 fails to be executed and thereby the procedures are caused to return to the Step 100 irrespective of the state that the existent inclination angle is smaller than the inclination angle corresponding to the threshold value $V_{M2}$.

As will be apparent from the above description, the number N of revolutions of the engine is reduced as far as possible and an inclination angle of the pump is increased in accordance with this embodiment of the invention. Consequently, it follows that the pump 2 can be operated under a condition of high torque efficiency and the engine 1 can be operated in a rotational range where a low fuel consumption rate is assured.

Figure 5:
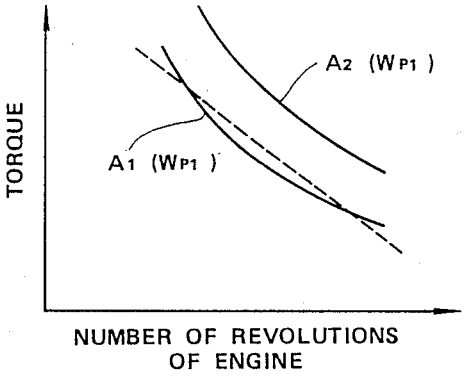
FIG. 5 is a graph exemplifying pump absorption torque characteristics corresponding to a magnitude of work to be undertaken.

Referring to FIG. 3 again, merely the characteristic A relative to an absorption torque in a case where the pump 2 is adapted to absorb a constant horse power W is shown in the drawing but, in practice, a plurality of characteristics relative to an absorption torque corresponding to a magnitude of absorption horsepower are set. For instance, absorption torque characteristics $A_1$ and $A_2$ corresponding to absorption horsepowers $W_{P1}$ and $W_{P2}$ are set as shown in FIG. 5 and they are stored in the memory 12. A mode for selecting a work $W_1$ is selected when a light work is undertaken, whereas a mode for selecting work $W_2$ is selected with the use of an operation mode shifting switch 13 shown in FIG. 1 when a heavy work is undertaken. Thus, the characteristic $A_1$ or $A_2$ is designated by such an operation for selecting a certain mode as mentioned above.

In the above-described embodiment, the absorption torque characteristic A represents a hyperbolic function as identified by an equation of $f(N)=W/N$. However, a monotonously decreasing function approximate to the above-noted function f (N), for instance, a function as represented by a dotted line in FIG. 5 which varies in inverse proportion to an increase of the number N of revolutions of the engine may be employed as a function representative of the characteristic A. In this case, it should of course be understood that a relation which represents that a value of W P Q is kept constant collapses to some extent as the number of revolutions of the engine varies. However, in some case, it will be preferable to carry out such controlling as mentioned above in dependence on an intensity of load.

Incidentally, in the above-described embodiment, controlling is achieved for N and V in order that a product of $n_E$ multiplied by $n_P$ reaches the maximum value, when it is assumed that a fuel consumption rate of the engine 1 is represented by a function of $n_E=F(N)$ relative to N and an operational efficiency of the pump 2 corresponding to an inclination angle of the swash plate is represented by a function of $n_P=G(V)$ relative to V.

Figure 8:
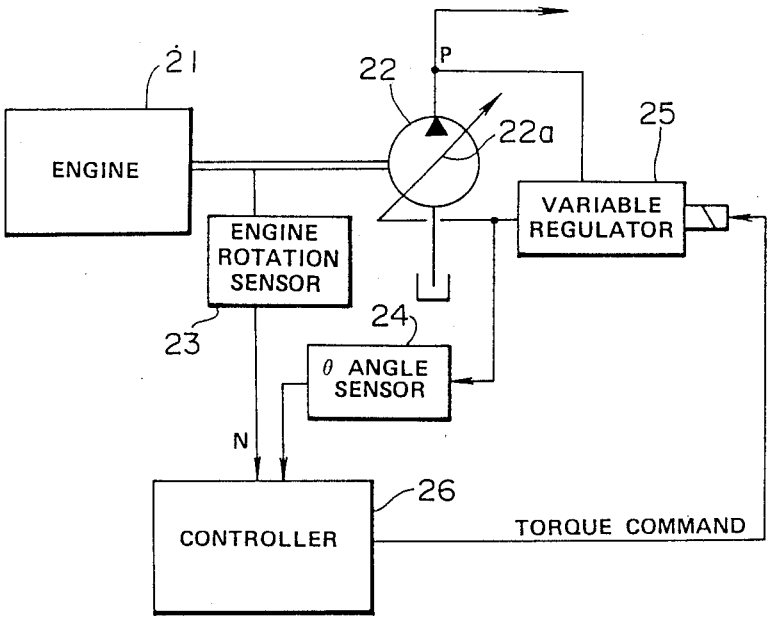
FIG. 8 is a block diagram illustrating an apparatus for controlling a hydraulic pump in accordance with other embodiment of the present invention.

FIG. 8 illustrates other embodiment of the preset invention.

Figure 10:
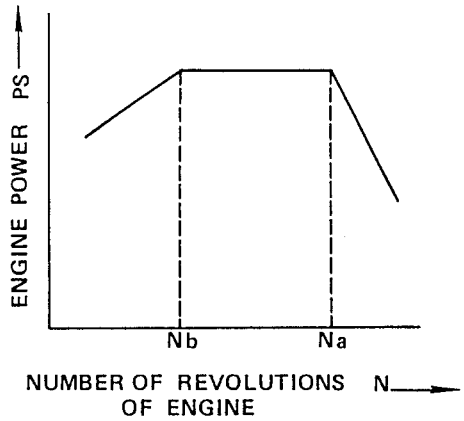
FIG. 10 is a graph exemplifying an output horsepower characteristic of an engine.
Figure 11:
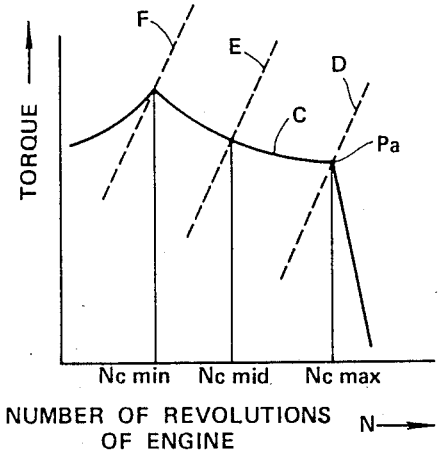
FIG. 11 is a graph illustrating a relationship between a torque characteristic of an engine and an absorption torque of a hydraulic pump.

Referring to the drawing, an engine 22 has a rated horse power characteristic as shown in FIG. 10. That is to say, it has a horsepower characteristic which assures that it can obtain a constant horsepower in a range as defined between number $N_b$ of revolution of the engine and number $N_a$ of revolutions of the engine. FIG. 11 illustrates a rated torque characteristic C for obtaining the above-noted rated horsepower characteristic and this torque characteristic is set with the aid of a governor (not shown) attached to the engine 22.

The number N of revolutions of the engine is detected by means of an engine rotation sensor 23 and an inclination angle 0 of the swash plate in a pump 22 is detected by means of an angle sensor 24.

A torque command to be issued to the pump 22 and a pressure of hydraulic oil delivered from the pump 22 are inputted into a variable regulator 25, and a swash plate 22a in the pump 22 is driven in such a manner that the pump 22 absorbs a torque in response to the torque command.

Figure 9:
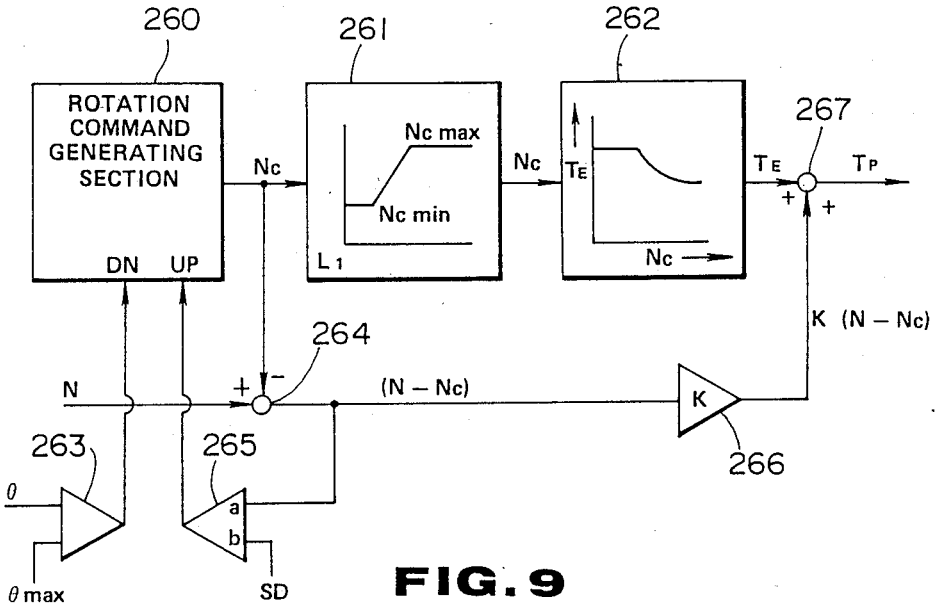
FIG. 9 is a block diagram exemplifying a structure of a controller shown in FIG. 8.

As shown in FIG. 9, a controller 26 is composed of a revolution number command generating section 260 for commanding a target number $N_c$ of revolutions of the engine, a limiter 261 for limiting the number $N_c$ of revolutions of the engine between the maximum value $N_{c\,max}$ (corresponding to $N_a$) and the minimum value $N_{c\,min}$ (corresponding to $N_b$), a function generator 262 for generating a command torque $T_a$ corresponding to the number $N_c$ of revolutions of the engine in response to an output from the command generating section 260, a comparator 263 for comparing the inclination angle $\theta$ of the swash plate detected by means of the angle sensor 24 with the maximum value of $\theta_{max}$ to generate a reduction command DN of the command revolution number $N_c$ when an inequality of $\theta < \theta_{max}$ is established, a subtracter 264 for obtaining a deviation $(N-N_c)$ of the number N of revolutions of the engine from the command number $N_c$ of revolutions of the engine, a comparator 265 adapted to output an increase command UP relative to $N_c$ when the deviation $(N-N_c)$ becomes larger than a preset value SD, an amplifier 266 for amplifying the deviation $(N-N_c)$ by K times, and an adder 267 for adding the command torque $T_a$ to the deviation $K(N-N_c)$ amplified by K times.

The revolution number command generating section 260 functions for reducing $N_c$ by number of revolutions identified by $\Delta N_c$ at a predetermined time interval when a reduction command DN is outputted from the comparator 263 and increasing $N_c$ by number of revolutions identified by $\Delta N_c$ at the predetermined time interval when an increase command UP is outputted from the comparator 265.

Figure 12:
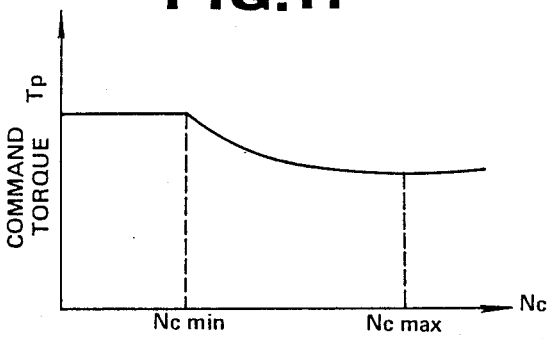
FIG. 12 is a graph illustrating an output characteristic of a function generator.

The function generator 262 has a variation pattern as shown in FIG. 12 corresponding to a variation pattern as seen in a range from $N_a$ to $N_b$ relative to a rated torque characteristic C shown in FIG. 11. This causes a command torque $T_E(N_c)$ generated in the function generator 262 to become a function which varies in dependence on the command revolution number $N_c$.

The revolution deviation $K(N-N_c)$ amplified by K times in the amplifier 266 is a primary function relative to the inclination K and is caused to move in parallel in accordance with variation of $N_c$.

A function represented by the following Equation (4) to which functions $T_E(N_c)$ and $K(N-N_c)$ relative to the command torque are added is obtainable in the adder 267.

$$T_P = T_E(N_c) + (N - N_c) \tag{4}$$

The function of the above Equation (4) is represented by lines D, E and F shown by dotted lines in FIG. 11 when $N_c$ assumes $N_{c\,max}$, $N_{c\,mid}$ and $N_{c\,min}$.

In a case where the absorption torque $T_p$ of the pump 22 is varied in accordance with the function of the Equation (4), the absorption torque $T_p$ matches with the rated torque of the engine 21 at a point $P_a$ shown in FIG. 11, for instance, when $N_c$ assumes $N_{c\,max}$.

Next, operation of the apparatus in accordance with this embodiment will be described below.

In the revolution number command generating section 260 shown in FIG. 9, for instance, the number of revolutions of the engine as identified by $N_c = N_{c\,max}$ is commanded at the early part of operation. At this moment, when it is assumed that the inclination angle $\theta$ of the swash plate in the pump 22 is represented by $\theta < \theta_{max}$ in the comparator 263, a reduction command DN relative to the command number $N_c$ of revolutions of the engine is outputted from the comparator 263. As a result, a processing for reducing the command number $N_c$ of revolutions of the engine by number of revolutions as identified by $\Delta N_c$ (for instance, 15 to 20 rpm) at a time interval identified by time $\Delta T$ (for instance, 100 ms) in the revolution number command generation section 260 is executed. Since the command relative to the number $N_c$ of revolutions of the engine is issued also to a governor (not shown) on the engine 21, it follows that the number of revolutions of the engine 21 is reduced by a step of $\Delta N_c$ at every time when the above-mentioned processing is executed.

On the other hand, a command signal indicative of the torque $T_p$ represented by the Equation (4) is outputted from the adder 267 shown in FIG. 9 so that it is applied to the variable regulator 25. The variable regulator 25 drives the swash plate 22a in accordance with a relation as represented by the command torque $T_p$, a pressure P of hydraulic oil delivered from the pump 22 and the following Equation (5) in order that an absorption torque of the pump 22 becomes the command torque $T_p$.

$$V = K_5 \frac{T_p}{P} \tag{5}$$

where

V ; volume of hydraulic oil discharged from the pump per one revolution thereof $K_5$; constant V in the above Equation (5) corresponds to an inclination angle $\theta$ of the swash plate, and the variable regulator 25 functions for varying the inclination angle $\theta$ of the swash plate so as to obtain V.

When the number N of revolutions of the engine is varied by a step of $\Delta N_c$ in the above-described manner, the pump load line D shown in FIG. 11 is caused to move toward another line F. This means that V in the Equation (5) is increased, that is to say, the inclination angle $\theta$ of the swash plate becomes larger.

When the inclination angle $\theta$ of the swash plate is increased to reach an angular position represented by $\theta = \theta_{max}$, the revolution number reduction command DN to be issued from the comparator 263 is interrupted.

Thus, according to this embodiment, the number of revolutions of the engine can be reduced as far as possible under such a condition that the engine is operated with a constant horsepower, and an inclination angle of the swash plate in the pump can be enlarged. Accordingly, an advantageous effect that a fuel consumption cost can be reduced and the pump can be operated at a high operational efficiency is obtained in the same manner as in the preceding embodiment.

Incidentally, in the preceding embodiment, the above-mentioned advantageous effect is obtained while the pump is operated with a constant horsepower, whereas in the embodiment as shown in FIG. 8, the advantageous effect is obtainable while the engine is operated with a constant horse power.

In a case where, for instance, an operator performs an operation for reducing load exerted on the pump 22 while the latter is operated under the condition of $\theta = \theta_{max}$, a difference $(N-N_c)$ in number of revolutions becomes larger as the number N of revolutions of the engine increases. Incidentally, the difference $(N-N_c)$ in number of revolutions usually exhibits a value of substantially zero.

The comparator 265 shown in FIG. 9 is adapted to add a revolution number increase command UP to the revolution number command generating section 260, when $(N-N_c)$ is in excess of a preset value SD, that is to say, when a load exerted on the pump 22 is reduced lower than a predetermined value.

As a result, a command number $N_c$ of revolutions of the engine is increased by number of revolutions identified by $\Delta N_c$ at a time interval as identified by $\Delta T$, and a processing for increasing the target number of revolutions of the engine continues until a difference $(N-N_c)$ in number of revolutions becomes smaller than a value of SD, that is to say, until a load torque (pump absorption torque absorbed by the pump) matches with an engine torque.

Thus, according to this embodiment, when a load exerted on the pump 22 is reduced rapidly, $N_c$ is caused to automatically increase and a matching point where the pump absorption torque absorbed by the pump matches with the engine torque is varied until a difference $(N-N_c)$ in number of revolutions becomes substantially zero.

Incidentally, in the foregoing embodiment, it is naturally possible to assure functions of the controller 26 shown in FIG. 9 with the aid of program controlling to be effected by a microcomputor.

Further, in the foregoing embodiment, a target inclination angle of the swash plate is mechanically obtained by introducing into the variable regulator 25 a pressure P of hydraulic oil delivered from the pump 22. However, the present invention should not be limited only to this. Alternatively, the target inclination angle of the swash plate may be electrically obtained by electrically detecting the pressure P of hydraulic oil delivered from the pump by means of a pressure sensor and utilizing an output from the pressure senor as well as an output from the adder 267.

Further, in the embodiment, an actual inclination angle $\theta$ of the swash plate is detected by means of the angle sensor 24 shown in FIG. 8 and it is then added to the comparator 263. However, it is naturally possible to use the aforesaid electrically obtained target inclination angle in place of the actual inclination angle $\theta$ which is obtained by means of the angle sensor 24.

Figure 13:
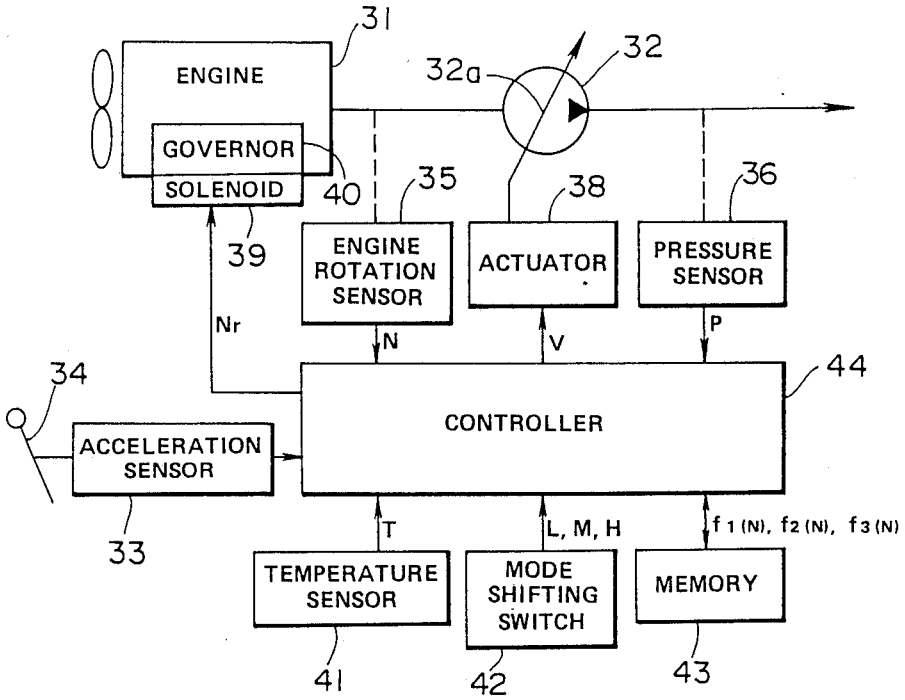
FIG. 13 is a block diagram illustrating an apparatus for controlling a hydraulic pump in accordance with another embodiment of the present invention.

FIG. 13 illustrates another embodiment of the present invention which is intended to deal with a problem in relation to overheating of the engine.

Incidentally, in the drawing, an engine 31, a pump 32, an acceleration sensor 33, an acceleration lever 34, an engine rotation sensor 35, a pressure sensor 36, an actuator 38 for driving a swash plate, a proportion solenoid 39 and a governor 40 are in common with those shown in FIG. 1 and therefore their repeated description will not be required.

A temperature sensor 41 serving as overheat detecting means outputs a signal indicative of a temperature T of the engine 31 (for instance, temperature of cooling water, temperature of exhaust gas or the like). Further, an operation mode shifting switch 42 is actuated by an operator in dependence on the operating condition, and a H mode for operation with a high intensity of load, a M mode for operation with an intermediate intensity of load and a L mode for operation with a low intensity of load are selectively indicated by the switch 42.

Now, when it is assumed that a generation horsepower generated by the engine 31 is identified by $W_E$ and an absorption horse power absorbed by the hydraulic pump 32 is identified by $W_P$, they are represented in the following manner under a certain load condition.

$$W_E = W_P = K_1 \cdot P \cdot Q = K_2 \cdot P \cdot N \cdot V \quad (6)$$

| | | |
|---|---|---|
| where P ; | pressure of hydraulic oil delivered from the pump | (6) (Kg/cm²) |
| Q ; | flow rate of hydraulic oil delivered from the pump | (liter/min) |
| V ; | flow rate of hydraulic oil delivered pump per 30 revolutions thereof | from the (cc/rev) |
| $K_1$, $K_2$ ; | constant | |

And, the following relationship is obtained from the Equation (6).

$$V = \frac{W_P}{K_2 \cdot P \cdot N} \quad (7)$$

Incidentally, as already mentioned above, V corresponds to an inclination angle of the swash plate 32a in a ratio as represented by 1:1. Accordingly, V in the Equation (7) suggests an inclination angle of the swash plate.

Figure 15:
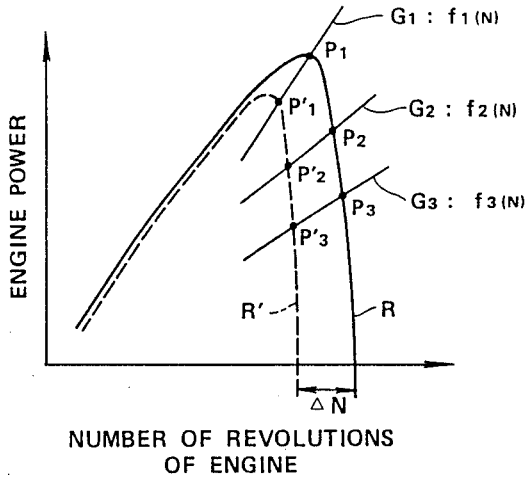

In FIG. 15 reference character R designates a rated horse power characteristic of the engine 31, that is to say, it does a horsepower characteristic under a condition that the acceleration lever 34 is actuated to a full position.

Usually, a construction machine is operated under a condition that the acceleration lever 34 is actuated to the full position and at this moment the maximum horsepower point of the engine 31 is represented by $P_1$.

Lines $G_1$, $G_2$ and $G_3$ shown in the drawing represent an absorption horsepower characteristic of the pump respectively which is set previously. These horse power characteristics represent monotonously increasing functions $f_1(N)$, $f_2(N)$ and $f_3(N)$ with respect to the number N of revolutions of the engine and they intersect a rated horsepower characteristic R of the engine 31 at points $P_1$, $P_2$ and $P_3$.

These horsepower characteristics are previously stored in the memory 43 shown in FIG. 13.

In order to vary an absorption horsepower $W_P$ absorbed by the pump 32 represented in the Equation (7) in accordance with the functions $f_1(N)$, $f_2(N)$ and $f_3(N)$, it suffices that an inclination angle of the swash plate in the pump 32 is controlled so as to obtain V as represented by the following Equations (8), (9) and (10).

$$V = \frac{f_1(N)}{K_2 \cdot P \cdot N} \quad (8)$$

$$V = \frac{f_2(N)}{K_2 \cdot P \cdot N} \quad (9)$$

$$V = \frac{f_3(N)}{K_2 \cdot P \cdot N} \quad (10)$$

When an inclination angle of the swash plate in the pump 32 is controlled in accordance with the Equations (8), (9) and (10) under a condition that the throttle lever 34 is actuated to a full position, it follows that the generation horsepower $W_E$ generated by the engine 31 matches with the absorption horsepower $W_P$ absorbed by the pump 32 at the points $P_1$, $P_2$ and $P_3$.

Further, when an amount of actuation of the throttle lever 34 is reduced and thereby the number of revolutions of the engine is reduced by an amount of $\Delta N$, that is to say, when a horsepower characteristic of the engine 31 is set as represented by a reference character R' in FIG. 15, it follows that the generation horsepower $W_E$ generated by the engine 31 matches with the absorption horsepower $W_P$ absorbed by the pump 32 at the points $P_1'$, $P_2'$ and $P_3'$, by controlling an inclination angle of the swash plate in accordance with the Equations (8), (9) and (10).

Figure 14:
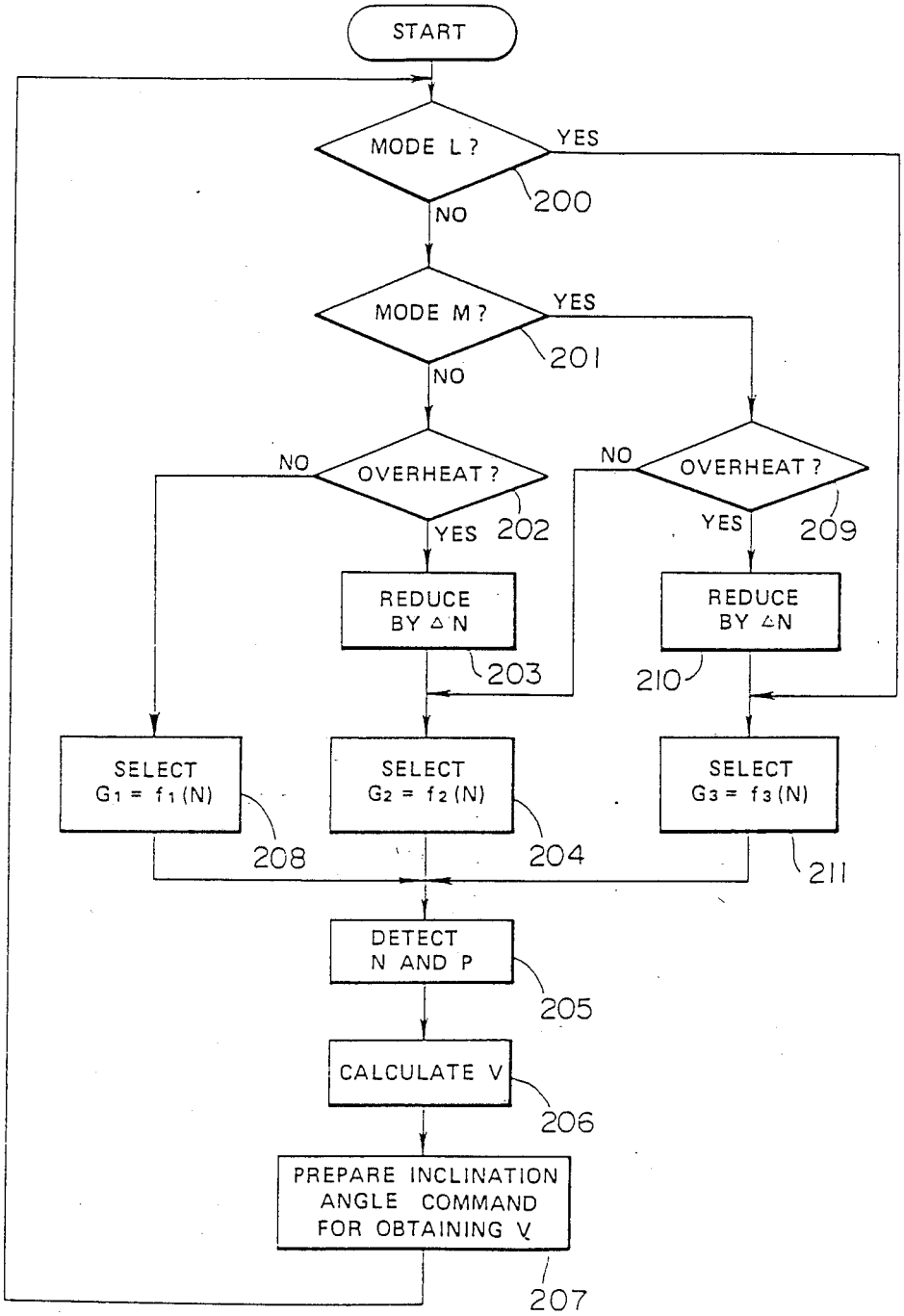
FIG. 14 is a flow chart exemplifying processing procedures of a controller shown in FIG. 13, FIGS. 15 and 16 are a graph exemplifying a relationship between a horsepower generated by an engine and a horsepower absorbed by a hydraulic pump respectively.

FIG. 14 illustrates processing means for a controller 44 shown in FIG. 13.

With respect to procedures to be executed, it is first judged whether or not an operation mode L is indicated by means of the operation shifting switch 42 (Step 200), and when it is found that the operation mode L is not indicated, it is judged during a next Step 201 whether an operation mode M is indicated or not. When it is found that both the operation modes L and M are not indicated, that is to say, when an operation mode H is indicated, it is judged during a next Step 203 whether the engine 31 is excessively heated or not, and when it is found that the result of judgment is represented by NO, among absorption horsepower characteristics $G_1$, $G_2$ and $G_3$ in FIG. 15 stored in the memory 43, the characteristic $G_1=f_1$ (N) is selected (Step 208).

On the other hand, when the result of judgment made during the Step 201 is represented by YES, it is judged during a Step 209 whether the engine 31 is excessively heated or not, and when it is fount that the engine 31 is not excessively heated, the characteristic $G_2=f_2$ (N) shown in FIG. 15 is selected during a Step 204. Further, when the result of judgment made during the Step 200 is represented by YES, the characteristic $G_3=f_3$ (N) shown in the drawing is selected during a Step 211.

It should be noted that judgment to be made during the Steps 202 and 209 as to whether the engine is excessively heated or not is made in response to an output from the temperature sensor 41.

After a processing for making a selection during either of the Steps 208, 204 and 211 is executed, the number N of revolutions of the engine 31 is detected in response to an output from the engine rotation sensor 35 and a pressure P of hydraulic oil delivered from the pump 31 is detected in response to an output from the pressure sensor 36 (Step 205).

When the characteristic $G_1=f_1$ (N) is selected during the Step 208, the arithmetic operation as represented in the Equation (8) is executed during a Step 206 with reference to the characteristic $f_1$ (N) and N and P detected during the Step 205 whereby a flow rate V of hydraulic oil delivered from the pump is obtained in order that the absorption horse power $W_P$ absorbed by the pump 32 assumes a value which conforms to $f_1$ (N).

Further, when the characteristic $G_2=f_2$ (N) is selected during the Step 204 and the characteristic $G_3=f_3$ (N) is selected during the Step 211, the arithmetic operations shown in the Equations (9) and (10) are executed during the Step 206 whereby a flow rate V of hydraulic oil delivered from the pump is obtained in order that the absorption horsepower $W_P$ absorbed by the pump assumes values which conforms to $f_2$ (N) and $f_3$ (N).

A swash plate inclination angle command (which is represented by a value corresponding to V) for obtaining a flow rate V of hydraulic oil from the pump detected during the Step 206 is prepared during a next Step 207 and it is then outputted to the actuator 38 for driving the swash plate.

As a result, the acceleration lever 34 is set to a full position, and in a case where it is found that the engine 31 is not excessively heated, it follows that an absorption horsepower absorbed by the pump 32 matches with a generation horsepower generated by the engine 31 at the points $P_1$, $P_2$ and $P_3$ shown in FIG. 15, when the characteristic $G_1=f_1$ (N), and the characteristic $G_2=f_2$(N) and the characteristic $G_3=f_3$ (N) are selected.

That is to say, in a case where the mode H is selected and operation is performed with a high intensity of load, a horsepower at the point $P_1$ is absorbed by the pump 32. Further, in a case where the mode M is selected and operation is performed with an intermediate intensity of load as well as in a case where the mode L is selected and operation is performed with a low intensity of load, horsepower at the points $P_2$ and $P_3$ are absorbed by the pump 32.

When operation is performed in accordance with the mode H or the mode L, in some case, the engine 31 is excessively heated due to an increased load.

According to the procedures shown in FIG. 14, in a case where it is judged during the Step 202 that the engine is excessively heated when the mode H is indicated, a processing for reducing the number of revolutions of the engine by $\Delta N$ is executed during the Step 203, and the absorption horse power characteristic $G_2=f_2$ (N) is selected during the Step 204.

Further, in a case where it is judged during the Step 209 that the engine is excessively heated when the mode M is indicated, similarly a processing for reducing the number of revolutions by $\Delta N$ is executed during the Step 210, and the absorption horsepower characteristic $G_3=f_3$ (N) is selected during the Step 211.

Incidentally, a processing to be executed during the Step 203 or 210 means that a signal indicative of the target number $N_r$ of revolutions of the engine applied to the proportion solenoid 39 is changed to a signal indicative of the number $N_r-\Delta N$ of revolutions of the engine. Thus, a horsepower characteristic of the engine 31 is represented by R' in FIG. 15.

Thereafter, the above-mentioned processing are executed during the Steps 205, 206 and 207. Thus, in a case where the engine is excessively heated under a condition that the mode H is indicated, a matching point where the absorption horsepower $W_P$ absorbed by the pump 32 matches with the generation horsepower $W_E$ generated by the engine 31 is shifted from the point $P_1$ to the point $P_2'$ in FIG. 15. Further, in a case where the engine is excessively heated under a condition that the mode M is indicated, the matching point is shifted from the point $P_2$ to the point $P_3'$.

It should be noted that processings to be executed during the Steps 203 and 210 for the purpose of reducing the target number of revolutions of the engine by $\Delta N$ continue until the excessively heated state of the engine disappears.

When the matching point is shifted from the point $P_1$ to the point $P_2'$ or it is shifted from the point $P_2$ to the point $P_3'$, a load exerted on the engine 31 is reduced remarkably. Accordingly, the engine 31 can be quickly restored to the normal operative state from the excessively heated state. Since a controlling operation for the swash plate in the pump 31 continues while the above-mentioned processings are executed, a work can proceed further without any occurrence of malfunction such as remarkable reduction of the number of revolutions of the engine or the like.

Incidentally, in this embodiment, the characteristics $G_1$, $G_2$ and $G_3$ shown in FIG. 15 are stored in the memory 43. However, it is possible to allow the controller 44 to arithmetically process pump absorption horse powers which conform to these characteristics.

Further, in the above-described embodiment, a practical manner to be employed when the acceleration lever 34 is actuated to a full position is shown. However, it should be noted that even in a case where the lever 34 is actuated to an intermediate operation position, it is possible to effect controlling in the same manner as mentioned above. In this case, it should of course be understood that also the characteristics $f_1$ (N), $f_2$ (N) and $f_3$ (N) in relation to the intermediate position are stored in the memory 43.

Figure 16:
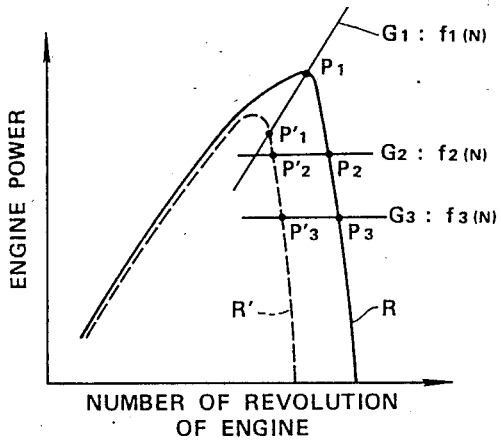

Further, in this embodiment, each of the pump absorption horsepower characteristics $G_2=F_2$ (N) and $G_3=f_3$ (N) is represented in the form of a monotonously increasing function relative to the number N of revolutions of the engine. As shown in FIG. 16, however, a constant function (constant horsepower characteristic) relative to N may be practically employed for these characteristics.

In a case where an absorption torque absorbed by the pump is controlled in accordance with the characteristic A shown in FIG. 3, the characteristics D, E and F shown in FIG. 11 or the characteristics $G_1$, $G_2$ and $G_3$ shown in FIG. 15, it is necessary to detect a pressure of hydraulic oil discharged from the pump. Conversely speaking, when it becomes impossible to detect a pressure of hydraulic oil discharged from the pump, it follows that the above-mentioned torque controlling fails to be effected properly, resulting in an occurrence of malfunction such as interruption of operation of the engine due to excessive load, complete failure of transmission of a torque outputted from the engine or the like.

Figure 17:
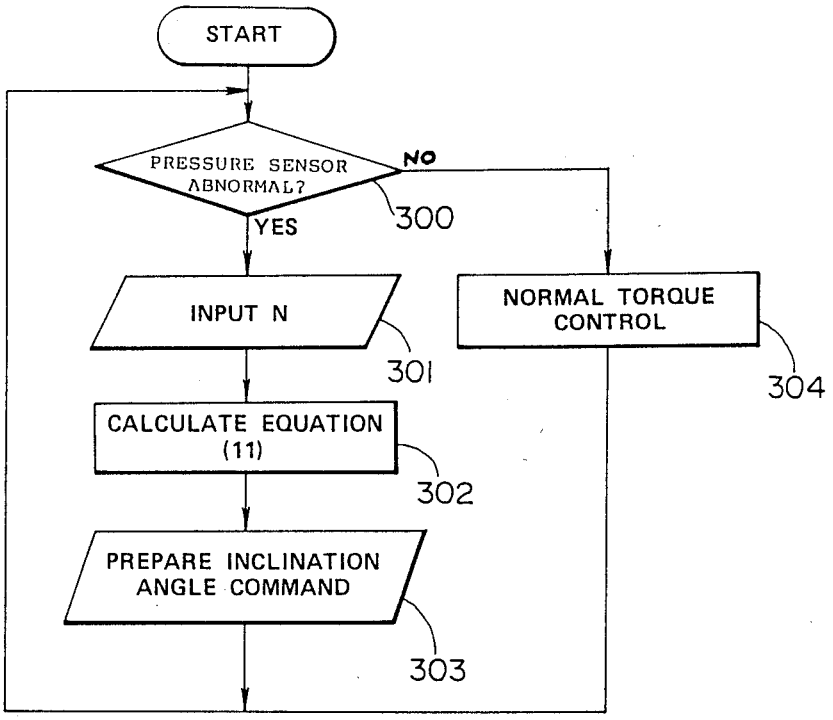
FIG. 17 is a flow chart illustrating processing procedures of a controller at the time when a pressure sensor becomes abnormal in function.

FIG. 17 illustrates procedures for avoiding an occurrence of the above-mentioned malfunction, and the procedures are executed by means of the controller 7 shown in FIG. 1 or the controller 44 shown in FIG. 13.

Figure 18:
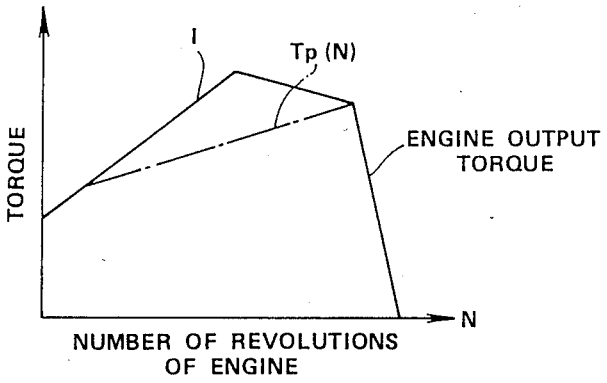
FIGS. 18 and 19 are a graph exemplifying a relationship between a rated torque of an engine and an absorption torque characteristic of a hydraulic pump applicable at the time when the pressure sensor becomes in function, respectively.

The hydraulic pump 2 or 32 has the maximum delivery pressure $P_{max}$ which can be outputted. Accordingly, when a pump absorption torque characteristic $T_P$ (N) which is not in excess of a rated torque of the engine, for instance, as shown by a dotted chain line in FIG. 18 is previously set and a flow rate V of hydraulic oil delivered from the pump per one revolution thereof is controlled so as to satisfactorily meet a relation as represented by the following equation, an absorption torque absorbed by the pump does not exceed an output torque I from the engine 2.

$$V = \frac{T_P(N)}{K + P\max} \quad (11)$$

where K ; constant

Here, the controllers 7 and 44 are so constructed that the limitative torque characteristic $T_P$(N) and the maximum delivery pressure $P_{max}$ are previously stored in the memory.

Incidentally, the limitative torque characteristic $T_P$ (N) is set so as to obtain an absorption torque as large as possible on the assumption that operation of the engine is not interrupted.

According to the procedures shown in FIG. 17, it is first judged whether or not there is existent an abnormality with the pressure sensors 6 and 36 (Step 300). Incidentally, this judgment is made, for instance, in the following manner. Namely, when the sensors 6 and 36 have a pressure detection range of 0 to 50 Kg/cm$^2$, their output voltage varies, for instance, in the range of 1 to 5 V in dependence on variation of the pressure P. Thus, when it is found that the output voltage is not in the range 1 to 5 V, it is judged by means of the controllers 7 and 44 that the sensors 6 and 36 are abnormal in function.

When it is judged during the Step 300 that the pressure sensor is abnormal in function, the number N of revolutions of the engine is inputted (Step 301), and an arithmetic operation shown in Equation (11) is then executed with reference to the number N of revolutions of the engine, the limitative torque characteristic $T_P$ (N)) shown in FIG. 18 and the maximum delivery pressure $P_{max}$ whereby a target flow rate V of hydraulic oil delivered from the pump is obtained. And, a swash plate inclination angle command for obtaining V is prepared and it is then outputted to the actuator 8 or 38 (Step 303) whereby an absorption torque to be absorbed by the pump is controlled in accordance with the torque characteristic $T_P$(N).

Incidentally, in a case where it is not detected during the Step 300 that the pump is abnormal in function, normal torque controlling is executed with reference to an output from the pressure senor (Step 304).

Figure 19:
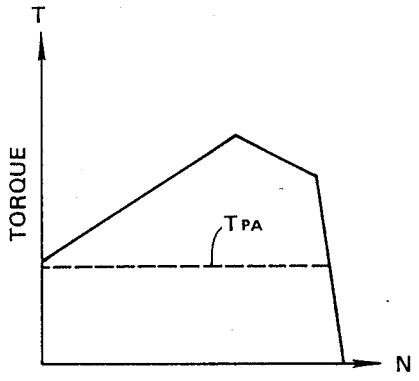

In the foregoing embodiment, the limitative torque characteristic $T_P$(N) with the number N of revolutions of the engine used as a variable therefor is set but the limitative torque of the pump may be fixedly set to a constant value $T_{PA}$ as shown in FIG. 19. Incidentally, it is preferable that this limitative torque value $T_{PA}$ is set to a value as large as possible on the assumption that an operation of the engine is not interrupted.

Figure 20:
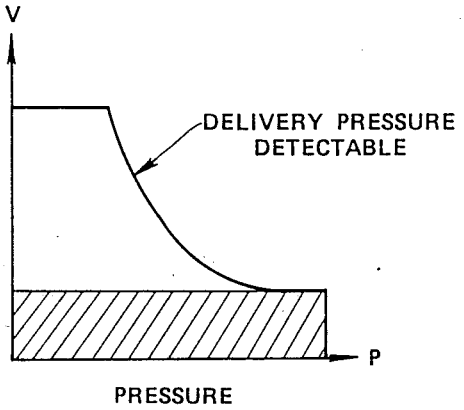
FIG. 20 is a graph showing a magnitude of absorption torque in a case where the pump absorption torque characteristic shown in FIG. 19 is applied.

When an inclination angle of the swash plate in the pump is set so as to obtain the constant torque $T_{PA}$ shown in FIG. 19 while the pressure sensor is abnormal in function, a torque of which intensity is represented by an inclined line in FIG. 20 can be absorbed by the pump.

When a series of processings are executed in the above-described manner, the pump outputs the torque $T_P$(N) or $T_{PA}$ even when the pressure sensor is abnormal in function. Thus, for instance, in a case of a vehicle for which this pump is used as a power source for movement, it is possible to displace the vehicle to a repairing factory or the like.

Incidentally, in the foregoing embodiment, the characteristic $T_P$ shown in FIG. 18 is stored in the memory and thereby it is possible to calculate a limitative torque value which conforms to $T_P$(N) with reference to N.

INDUSTRIAL APPLICABILITY

Since an apparatus for controlling a hydraulic pump according to the present invention functions in the above-described manner, it is advantageous that the apparatus is applied to a hydraulic pump for a construction machine which has a need of reducing fuel consumption cost and increasing an operational efficiency of the pump.

We claim:

1. An apparatus for controlling a variable displacement type hydraulic pump including an engine as a driving power source comprising;

means for detecting the number of revolution of said engine, means for detecting a pressure of hydraulic oil delivered from said hydraulic pump, means for setting a pump absorption torque characteristic which monotonously decreases with reference to the number of revolutions of the engine, means for looking for an inclination angle of a swash plate in the pump with reference to said pump absorption torque characteristic and said pressure of hydraulic oil delivered from the pump, means for controlling said swash plate in the pump so as to assure said inclination angle of the swash plate, and means for reducing the number of revolutions of the engine under a condition that an absorption torque absorbed by the pump does not exceed a rated torque of the engine.

2. an apparatus for controlling a hydraulic pump as claimed in claim 1, wherein said pump absorption torque characteristic is a torque characteristic with which a constant work is undertaken by said pump.

3. An apparatus for controlling a hydraulic pump as claimed in claim 1, wherein said apparatus further includes means for setting a plurality of kinds of pump absorption torque characteristics and means for selecting said characteristics.

4. An apparatus for controlling a hydraulic pump as claimed in claim 1, wherein said condition under which an absorption torque absorbed by the engine does not exceed an allowable torque is set with reference to the number of revolution of the engine in respect of a point where the pump absorption torque characteristic intersects a rated torque characteristic of the engine.

5. An apparatus for controlling a hydraulic pump as claimed in claim 1, wherein said means for reducing the number of revolutions of the engine is so constructed that the number of revolutions of the engine is reduced at a predetermined time interval by a very small number of revolutions.

6. An apparatus for controlling a hydraulic pump as claimed in claim 1, further comprising:

means for detecting an abnormality with said pressure detecting means.

means for setting a pump absorption torque characteristic so as to reduce an absorption torque absorbed by the pump lower than an output torque from the engine, and means for controlling said inclination angle of said swash plate in the pump so as to allow said absorption torque absorbed by the pump to exhibit a value which conforms to said pump absorption torque characteristic when means for detecting a pressure of hydraulic oil delivered from the pump becomes abnormal in function.

7. An apparatus for controlling a hydraulic pump as claimed in claim 6. Wherein said pump absorption torque characteristic is represented by a function which varies in dependence on the number of revolutions of the engine.

8. An apparatus for controlling a hydraulic pump as claimed in claim 6. Wherein said pump absorption torque characteristic is a characteristic which exhibits a constant value relative to the number of revolutions of the engine.

9. An apparatus for controlling a variable displacement hydraulic pump including an engine as a driving power source, said engine having a constant horsepower characteristic at a predetermined revolution range, comprising;

means for detecting the number of revolutions of the engine, means for setting a target pump absorption torque $T_P$ in means for detecting a pressure of hydraulic oil delivered from said pump, means for detecting that the engine is excessively heated, means for indicating a plurality of operation modes corresponding to an intensity of load, means for setting a plurality of pump absorption horsepower characteristics corresponding to said operation modes and setting a pump absorption horsepower characteristic relative to an operational mode for a light intensity of load in place of the existent pump absorption horsepower characteristic which is set for case where it is detected that the engine is excessively heated, means for looking for an inclination angle command relative to a swash plate in the pump so as to obtain an absorption horsepower which conforms to said set absorption horsepower characteristic with reference to the set absorption horsepower characteristic, the number of revolutions of the engine and said pressure of hydraulic oil delivered from the engine, means for reducing the number of revolutions of the engine to a predetermined number of revolutions when it is detected that the engine is excessively heated, and means for controlling said swash plate so as to allow an inclination angle of the swash plate in the pump to accordance with the following equation, $$T_P = T_E(N_c) + (N - N_c)$$

where

TE ($N_c$) ; rated torque characteristic of the engine at a predetermined revolution number range K ; constant N ; number of revolutions of the engine $N_c$; target number of revolutions of the engine means for controlling a swash plate in the pump so as to obtain an absorption torque with reference to said target torque absorption torque and a pressure of hydraulic oil delivered from the pump, and means for reducing said target number of revolutions of the engine under a condition that an inclination angle of said swash plate is smaller than a preset angle.

10. An apparatus for controlling a hydraulic pump as claimed in claim 9, wherein said means for reducing the target number of revolutions of the engine is so constructed that the number of revolutions of the engine is reduced at a predetermined time interval by a very small number of revolutions.

11. An apparatus for controlling a variable displacement type hydraulic pump including an engine as a driving power source comprising;

means for detecting the number of revolutions of said engine, assume a magnitude which conforms to said swash plate inclination angle command.

12. An apparatus for controlling a hydraulic pump as claimed in claim 11, wherein said means for detecting that the engine is excessively heated is a temperature sensor for detecting a temperature of the engine.

13. An apparatus for controlling a hydraulic pump as claimed in claim 11, wherein each of said pump absorption horsepower characteristics is represented by a function which monotonously increases in relation to the number of revolutions of the engine.

14. An apparatus for controlling a hydraulic pump as claimed in claim 11, further comprising:

means for detecting an abnormality with said pressure detecting means, means for setting a pump absorption torque characteristic so as to reduce an absorption torque absorbed by the pump lower than an output torque form the engine, and means for controlling said inclination angle of said swash plate in the pump so as to allow said absorption torque absorbed by the pump to exhibhit a value which conforms to said pump absorption torque characteristic when said means for detecting a pressure of hydraulic oil delivered from the pump becomes abnormal in function.

15. An apparatus for controlling a hydraulic pump as claimed in claim 14, wherein said pump absorption torque characteristic is represented by a function which varies in dependence on the number of revolutions of the engine.

16. An apparatus for controlling a hydraulic pump as claimed in claim 14, wherein said pump absorption torque characteristic is a characteristic which exhibits a constant value relative to the number of revolution of the engine.

* * * * *